US006259173B1

(12) United States Patent
Dias et al.

(10) Patent No.: US 6,259,173 B1
(45) **Date of Patent: *Jul. 10, 2001**

(54) MODULAR PROTECTIVE RELAY WITH SUBMODULES

(75) Inventors: Clive Dias, Pickering; Marzio Pozzuoli, Maple, both of (CA)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,632

(22) Filed: Jun. 23, 1998

(51) Int. Cl.[7] ..... H01H 9/20
(52) U.S. Cl. ..... 307/147; 361/731
(58) Field of Search ..... 361/729–731, 361/600, 622, 629, 633, 636, 640, 657, 823; 307/147

(56) References Cited

U.S. PATENT DOCUMENTS

Re. 34,064 * 9/1992 Tury et al. ..... 74/335
5,021,764 * 6/1991 Mabee ..... 340/439
5,042,133 * 8/1991 Peterson et al. ..... 29/407
5,065,135 * 11/1991 Leigh-Monstevens et al. ..... 340/463
5,207,613 * 5/1993 Ferchau et al. ..... 454/184
5,237,484 * 8/1993 Ferchau et al. ..... 361/689
5,243,522 * 9/1993 Salzmann ..... 364/424.1
5,289,363 * 2/1994 Ferchau et al. ..... 363/141
5,751,536 * 5/1998 Haddad et al. ..... 307/38
5,752,047 * 5/1998 Darty et al. ..... 361/2
5,811,878 * 9/1998 Harmoinen et al. ..... 257/723
5,841,634 * 11/1998 Visser ..... 361/699
5,978,220 * 11/1999 Frey et al. ..... 361/699
6,014,705 * 1/2000 Koenck et al. ..... 709/230

* cited by examiner

*Primary Examiner*—Fritz Fleming
(74) *Attorney, Agent, or Firm*—Carl B. Horton; Kevin T. Duncan; Hunton & Williams

(57) ABSTRACT

A protective relay having internal processing circuitry embodied by removable and replaceable modules. Each module includes a main circuit board having common circuitry and also includes removable and replaceable submodules which electrically connect with the main circuit board to perform specific functions. The protective relay can have its functions altered by replacing one or more modules or submodules.

16 Claims, 2 Drawing Sheets

MODULAR PROTECTIVE RELAY WITH SUBMODULES

FIELD OF THE INVENTION

The present invention relates to protective relays. More particularly, the present invention relates to protective relays which include interchangeable parts.

BACKGROUND OF THE INVENTION

Protective relay devices are necessary elements of an electrical power distribution system, as they provide a variety of protection and control functions. Protective relays monitor conditions in the power distribution system and operate circuit breakers in response to the detection of adverse conditions, thereby protecting various segments and components of the power distribution system from damage.

Older protective relays were analog devices, which have been largely replaced by digital protective relays. Digital protective relays include digital processing circuitry which can be programmed to provide a wider variety of protection and control functions than were available with analog relay devices.

Typically, digital protective relays include relay processing circuitry to perform various protective control functions. The relay processing circuitry can be implemented by various configurations of input/output (I/O) circuits, current transformers, voltage transformers, etc. These configurations are generally fixed within the protective relay unit, making it relatively difficult and time-consuming to repair or replace the relay processing circuitry or portions thereof.

U.S. Pat. No. 4,742,428 to Conrad discloses a protective relay which includes an operating unit that can be withdrawn from an insulating housing through an opening in the front of the housing. The withdrawability of the protective relay circuitry allows for routine testing, maintenance, and replacement of the internal relay circuitry with minimal disruption of the power distribution system. However, the Conrad protective relay includes otherwise conventional relay circuitry which is fixed in location within the withdrawable operating unit.

It would be desirable for a protective relay device to allow relatively easy replacement or repair of relay processing circuitry.

SUMMARY OF THE INVENTION

The present invention overcomes the above-described problems, and achieves additional advantages, by providing for a protective relay in which the relay processing circuitry is implemented in the form of removable and replaceable modules, each of which performs a specified function. Each module includes a main control board having basic circuitry required for all intended module functions, and also includes removable and replaceable submodules which include specialized circuitry for performing specific functions. The modules can include a power supply module, a CPU module, and at least one digital signal processing module. The submodules can include I/O cards and voltage or current transformer cards. According to the exemplary embodiments disclosed below, the present invention allows the functions of a protective relay to be changed by replacement of one or more modules or one or more submodules.

BRIEF DESCRIPTION OF THE DRAWINGS

The invention can be understood more completely by reading the following Detailed Description in conjunction with the accompanying drawings, in which like elements are designated by like reference indicators, and in which.

DETAILED DESCRIPTION

Figure 1:
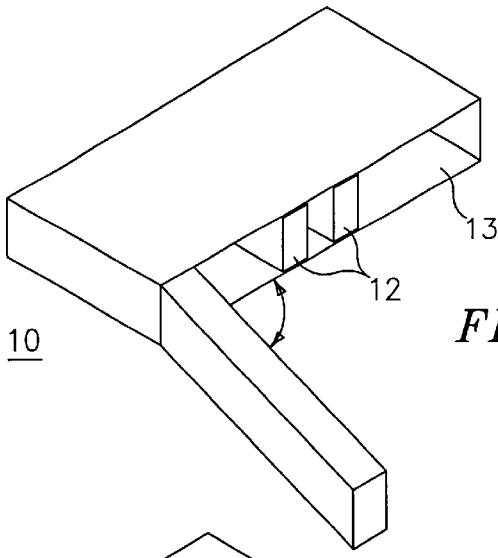
FIG. 1 shows a protective relay device incorporating the modular/submodular structure contemplated by the present invention.
Figure 4:
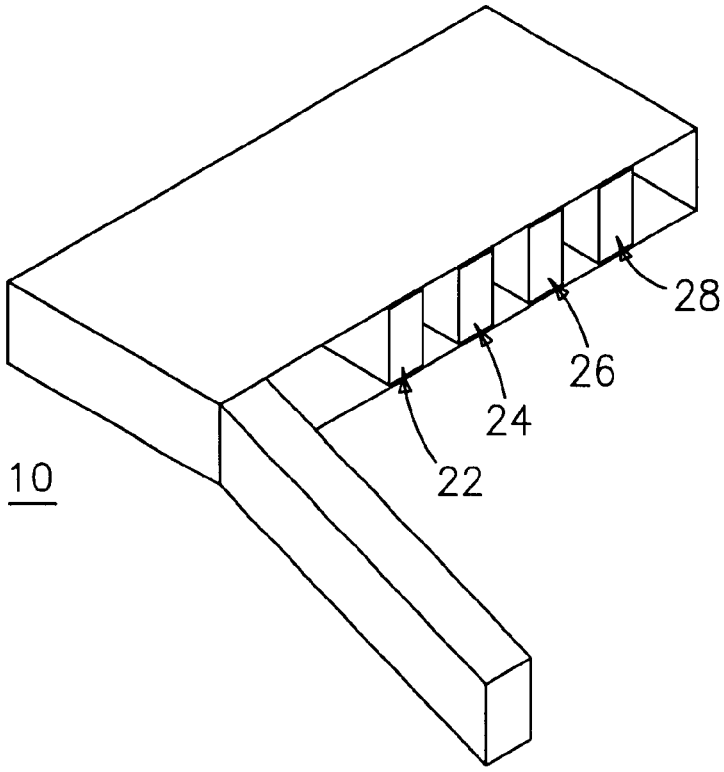
FIG. 4 shows a protective relay device incorporating the modular/submodular structure contemplated by the present invention showing various modules inserted in the protective relay device.

Referring now to FIG. 1, a protective relay device incorporating modules is shown. The protective relay device 10 is shown as having a hinged panel which provides access to the internal protective relay circuitry, such as the panel described in the copending, commonly assigned application entitled "Modular Control Panel for a Protective Relay", filed on an even date herewith, the entirety of which is incorporated by reference in this application. The internal protective relay circuitry of the protective relay device 10 is provided in the form of modules 12. Each module performs a specified function or set of functions relating to the protection and control of an electrical power distribution system (not shown) served by the protective relay device. FIG. 4 shows a protective relay device 10 of the present invention with various exemplary submodules inserted therein. Exemplary modules can include a power supply module 22, a current transformer module 24, a central processing unit (CPU) module 26, a digital signal processor (DSP) 28 module, etc. Each module 12 is separately removable and replaceable (for example, by slidably engaging or disengaging slots or guides in the protective relay housing), allowing the relay device 10 to be easily upgraded or repaired by simple removal and replacement of one or more modules. A backplane 13 capable of electrical and mechanical connection to a plurality of the independently removable and replaceable modules 12 is provided within the relay 10.

Figure 2:
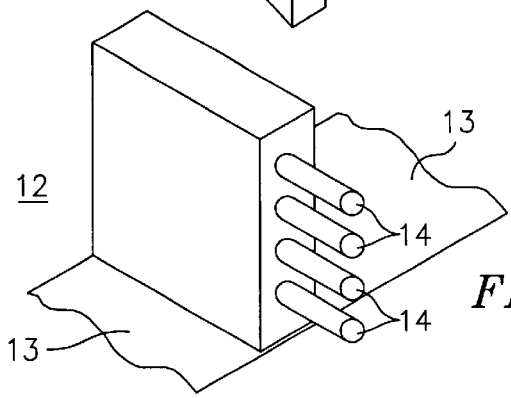
FIG. 2 is a module removed from the protective relay device of FIG. 1.

Referring now to FIG. 2, an individual module 12 is shown. The module is provided with contacts 14 at one end to electrically connect the module to the power distribution system. At the opposite end, the module 12 is provided with connections (not shown) to communicate with a user interface (e.g., the panel of the relay device 10). The contacts 14 are preferably connected to the power distribution system via a terminal block, which can be a conventional terminal block or a modular terminal block such as is described in the copending, commonly-assigned application entitled "Terminal Block for a Protective Relay", filed on an even date herewith, and which is incorporated by reference in its entirety.

Figure 3A:
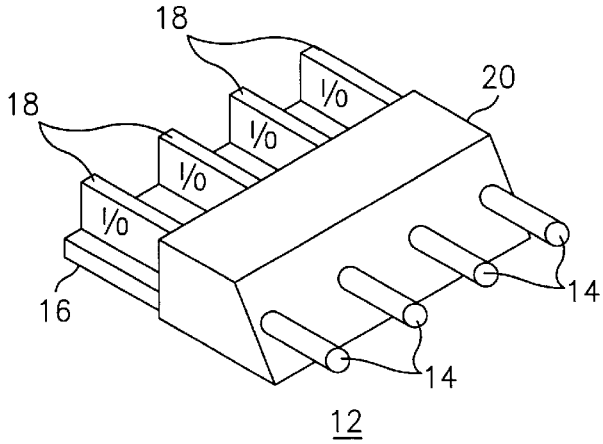
FIGS. 3*a–b* show a partial cutaway view and a cross-sectional view, respectively, of the module of FIG. 2.
Figure 3B:
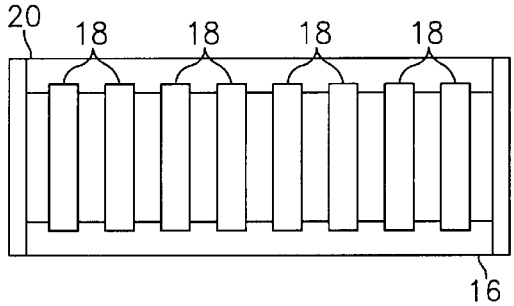

Referring now to FIGS. 3*a–b,* a partial cutaway view and a cross-sectional view, respectively, of the module 12 are shown. As can be seen in FIG. 3*a,* the module 12 is comprised of a main control board 16 and a plurality of submodule cards 18. In FIG. 3*a,* the submodule cards are shown as being input/output (I/O) cards, but the submodule cards can alternatively be voltage transformer cards, current transformer cards, or any other type of card to enable the module 12 to perform its intended function or functions. The main control board 16 preferably contains circuitry common to all intended module functions, and is fixed within the module housing 20. The submodule cards 18 include specialized circuitry to enable the module to perform specific intended module functions (e.g., transformer cards having specific voltage ratings or for enabling the module to perform specific types of input/output operations). The submodule cards 18 are separately removable and replaceable from the main control board 16 and a module housing 20. The contacts 14 are designed to mate with a male terminal block, and are preferably soldered on to the submodule cards 18.

As shown in FIG. 3*b,* the submodule cards 18 are mechanically connected to the housing 20 along one side, and are electrically and mechanically connected to the main control board 16 along the opposite side. Preferably, the submodule cards 18 are slidably engageable with the main control board 16 to establish a suitable electrical and mechanical connection. As there are many different types of suitable connections, none will be discussed specifically here.

A module according to the present invention can be said to comprise a female terminal block which mates with a male terminal block such as that shown and described in the copending, commonly-assigned application entitled "Terminal Block for a Protective Relay". Preferably, the housing 20 should be formed such that a module according to the present invention advantageously accepts such a male terminal block in any configuration, regardless of whether the male terminal block includes shorting fingers. To achieve this, and prevent shorting when the module is mated with a male terminal block having shorting fingers, the module/female block housing 20 is provided with extensions (not shown) of a suitable length which are positioned to break the shorting finger contact after electrical contact is established between the contacts of the male terminal block and the female terminal block/module.

The contacts of the female terminal block/module are preferably designed to withstand a current of approximately 500 amps for approximately one second, so as to be operable in a power distribution system.

An assembled module having submodules according to the present invention can be easily inserted into a protective relay and secured by using Tinnerman clips or other suitable securing means.

As exemplified by the embodiments described above, a modular/submodular protective relay according to the present invention can provide numerous advantages over conventional protective relay devices. For example, the protective relay can easily have modules removed and replaced in the field to allow the functions of the protective relay to be enhanced or changed, or to allow easy repairs. Further, because the modules can be provided with submodules as described above, an individual module can have submodules removed and replaced in the field to allow the functions of the associated module to be enhanced or changed, or to allow easy repairs. These aspects of the present invention provide significant advantages over conventional protective relays which have fixed configurations of digital input and output circuitry and/or fixed combinations of current and voltage transformers.

It will be appreciated that while the foregoing description includes many details and specificities, these have been given for illustrative purposes only, and are not intended to limit the invention. Many modifications to the embodiments described above can be readily achieved without departing from the spirit and scope of the invention, as defined by the following claims and their legal equivalents.

What is claimed is:

1. A protective relay, comprising:

a relay housing having a backplane capable of electrical and mechanical connection thereto; and a plurality of modules, including a power supply module, a CPU module, and at least one DSP module for providing protective control of an electrical power distribution system, said plurality of modules being removably and replacably mounted to the backplane, wherein each of said plurality of of modules includes a module housing and a plurality of separately removable and replaceable submodules disposed in said module housing, wherein one or more of the plurality of submodules includes at least one contact, the at least one contact extending from the module housing for connected to an electrical distribution system such that functions of a module can be changed by replacing one or more of the submodules contained therein.

2. The protective relay of claim 1, wherein the at least one contact can withstand a current of approximately 500 amps for approximately one second.

3. The protective relay of claim 1, wherein one or more of the modules include at least one contact for connection to a terminal blocks, regardless of whether the terminal block includes shorting fingers.

4. The protective relay of claim 3, wherein the modules break the shorting fingers only after electrical contact between the terminal block and the at least one contact.

5. The protective relay of claim 1, wherein the submodules are input/output submodules.

6. The protective relay of claim 1, wherein the submodules are current transformer submodules.

7. The protective relay of claim 1, wherein the submodules are voltage transformer submodules.

8. The protective relay of claim 1, further comprising a main control board disposed within the module housing, wherein each of the plurality of submodules is mechanically connected to the module housing along one side and is electronically and mechanically connected to the main control board along an opposite side thereof.

9. A module for performing a set of one or more functions in a protective relay, comprising:

a module housing;

a main control board contained within the housing; and a plurality of submodules removably inserted into the housing, one or more of the plurality of submodules including at least one contact, the at least one contact extending from the module housing and being connectable with the main control board, each submodule performing portions of the module functions and capable of communication with other submodules via the main control board, wherein the module is removably insertable in a relay housing of a protective relay.

10. The module of claim 9, wherein the at least one contact can withstand a current of approximately 500 amps for approximately one second.

11. The module of claim 9, wherein the module includes at least one contact such that when inserted into the relay housing, the at least one contact mates with a terminal block, regardless of whether the terminal block includes shorting fingers.

12. The module of claim 11, wherein the module breaks the shorting fingers only after electrical contact between the terminal block and the at least one contact.

13. The module of claim 9, wherein the submodules are input/output submodules.

14. The module of claim 9, wherein the submodules are current transformer submodules.

15. The module of claim 9, wherein the submodules are voltage transformer submodules.

16. The module of claim 9, wherein each of the plurality of submodules is mechanically connected to the module housing along one side and is electronically and mechanically connected to the main control board along an opposite side thereof.

* * * * *